US009088081B2

(12) United States Patent
Hildebrandt

(10) Patent No.: US 9,088,081 B2
(45) Date of Patent: Jul. 21, 2015

(54) ELECTRICAL OUTLET SEALING SYSTEM

(71) Applicant: Mark D. Hildebrandt, Saline, MI (US)

(72) Inventor: Mark D. Hildebrandt, Saline, MI (US)

(73) Assignee: SUNVENTRIX, Saline, MI (US)

( * ) Notice: Subject to any disclaimer, the term of this patent is extended or adjusted under 35 U.S.C. 154(b) by 78 days.

(21) Appl. No.: 13/912,724

(22) Filed: Jun. 7, 2013

(65) Prior Publication Data

US 2013/0330965 A1 Dec. 12, 2013

Related U.S. Application Data

(60) Provisional application No. 61/656,707, filed on Jun. 7, 2012.

(51) Int. Cl.

| | |
|---|---|
| ***H01R 13/73*** | (2006.01) |
| ***H01R 13/00*** | (2006.01) |
| ***H01R 13/52*** | (2006.01) |
| *H01R 24/76* | (2011.01) |

(52) U.S. Cl.

CPC ..... *H01R 13/00* (2013.01); *H01R 13/521* (2013.01); *H01R 24/76* (2013.01)

(58) Field of Classification Search

USPC ..... 439/135–145, 559; 174/67

See application file for complete search history.

(56) References Cited

U.S. PATENT DOCUMENTS

| | | | | |
|---|---|---|---|---|
| 4,293,173 | A * | 10/1981 | Tricca | 439/148 |
| 5,477,010 | A * | 12/1995 | Buckshaw et al. | 174/67 |
| 6,984,139 | B1 * | 1/2006 | Lai | 439/142 |
| 7,458,831 | B2 * | 12/2008 | Okada et al. | 439/139 |
| 7,462,046 | B2 * | 12/2008 | Burchell, Jr. | 439/135 |
| 2004/0203270 | A1 * | 10/2004 | Wang | 439/136 |
| 2005/0020112 | A1 * | 1/2005 | De Cell et al. | 439/135 |
| 2010/0000757 | A1 * | 1/2010 | Husain et al. | 174/58 |
| 2013/0040495 | A1 * | 2/2013 | Moss | 439/625 |

* cited by examiner

*Primary Examiner* — Jean F Duverne
(74) *Attorney, Agent, or Firm* — Brinks Gilson & Lione

(57) ABSTRACT

A system for sealing a building electrical outlet of the type mounted within a wall surface of the building having one or more electrical plug sockets adapted to receive an electrical plug and a cover plate. The system includes two primary components. A gasket formed of an elastomeric material is provided with a pair of electrical terminal slots. A plug cover element forms a front cover panel and includes a pair of tabs extending from a back of the face surface to engage the electrical plug socket terminal slots. Two modes of operation are available. When an electrical plug is inserted into the electrical plug socket, the gasket is positioned between the plug and the socket to seal against air infiltration. When an electrical plug is not inserted into the socket, the plug cover is used to maintain the gasket in position for sealing against the electrical plug socket.

16 Claims, 2 Drawing Sheets

ELECTRICAL OUTLET SEALING SYSTEM

CROSS-REFERENCE TO RELATED APPLICATION

This application claims priority to U.S. Provisional Patent Application Ser. No. 61/656,707, filed Jun. 7, 2012.

FIELD OF THE INVENTION

This invention relates to a system for sealing building interior electrical outlets for reducing air infiltration into buildings.

BACKGROUND

In an effort to reduce utility costs and energy use, homeowners and building owners around the world seek to reduce heat loss during winter, and air conditioning loads during summer months. In addition to providing thermal insulation to reduce conductive heat loss, an important factor in controlling and maintaining temperature within a building is the reduction of outside air infiltration. Numerous measures are taken to reduce air infiltration such as the use of building wraps and new window and door technologies designed to reduce air leakage. Another point of air infiltration is electrical outlets which are mounted in penetrations through building interior wall boards of perimeter walls. The openings provided for electrical outlets in such walls represent a pathway for air infiltration. It is known to use foam type gaskets underneath an electrical outlet cover plate to help reduce air infiltration. However, even when such gaskets are used, there remains a gap around the electrical outlet socket as well as through the electrical outlet socket openings themselves. This invention provides a system and a kit which effectively reduces air infiltration through the pathways mentioned previously.

SUMMARY

This invention provides an electrical outlet sealing gasket and a system or kit. The system or kit is formed of two primary components. One component is an elastic sealing gasket which can be trapped between an electrical plug and a wall socket which seals the gap around the wall socket as well as the socket electrical terminal openings. When an electrical plug is not plugged into the electrical outlet, a plastic plug cover is used with the gasket, which traps the gasket in position to provide sealing, and further provides a child safety feature.

DETAILED DESCRIPTION OF THE INVENTION

Figure 9:
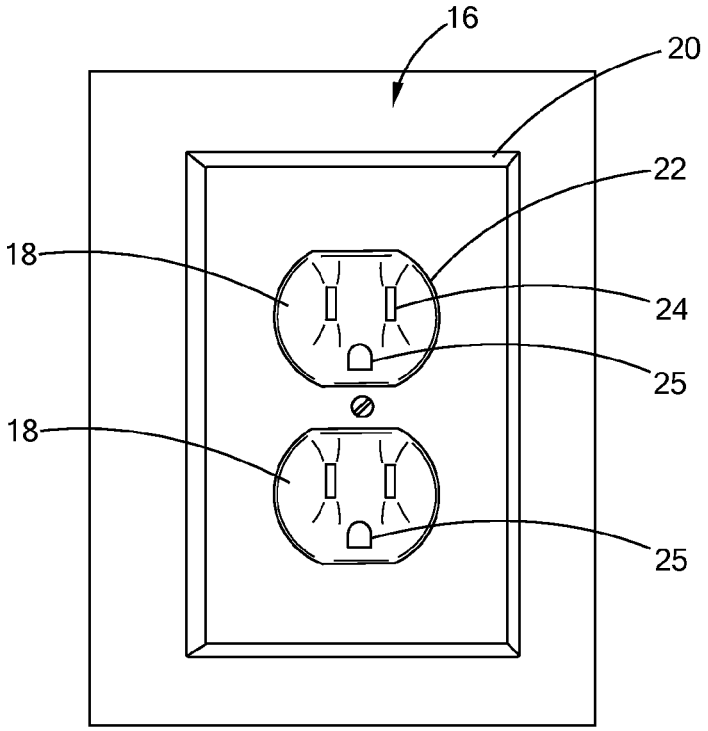
FIG. 9 is a perspective view of a conventional wall outlet with which the present invention may be used.

Now with reference to the Figures, features of the present invention are illustrated. Electrical outlet sealing system or kit 10, generally comprises two components; gasket 12 and plug cover 14. These components are adapted for use with a conventional electrical wall outlet 16 shown in FIG. 9 which has a pair of conventional so-called duplex plug sockets 18. Wall outlet 16 is mounted into an interior wall board (or wall) of a building exterior wall using conventional electrical boxes (not shown). As is conventional, outlet cover 20 provides enhanced decorative appearance of wall outlet 16 and prevents direct access to internal wiring and terminations. Each duplex plug socket 18 conventionally includes a pair of slots 24 to receive spade type plug terminals 28 (described in more detail below). Optionally socket 18 may also include a round port 25 for a ground lug 30 when the socket is a so-called grounded receptacle. As mentioned previously, a problem in providing energy efficiency for building interiors is the infiltration of air into the building interior. This can occur through multiple points within the building. One source of leakage is around the gap 22 which surrounds the perimeter of plug sockets 18, as well as through the electrical socket slots 24 and ground port 25 themselves.

Figure 11:
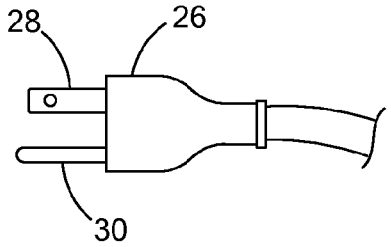
FIG. 11 is a side view of a conventional electrical plug, which may be the used with system of the present invention.

FIG. 11 illustrates a conventional electrical plug 26 adapted to be mated with plug sockets 18. Plug 26 includes a pair of separated spade terminals 28, and may optionally include a round cross-section ground lug terminal 30.

Figure 8:
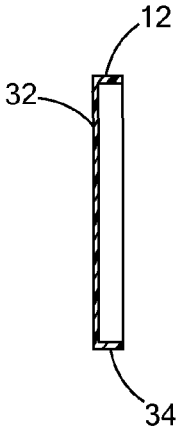
FIG. 8 is a cross-sectional view taken along line 8-8 from FIG. 7.

Now with reference to FIGS. 1 through 8, gasket 12 is shown which is preferably formed as a thin walled molding made of an elastomer such as a silicone type rubber material. Gasket 12 forms a front face surface 32 and has extending from the front face surface a perimeter wall 34, which circumscribes the outer perimeter of the front face surface. Preferably, front face 32 and perimeter wall 34 have similar or equivalent wall thicknesses. FIG. 8 provides a cross-sectional view through gasket 12 showing its thin wall construction.

Front face surface 32 of gasket 12 forms a pair of separated slots 36 allowing passage of plug spade terminals 28. Front face 32 has a scoring 38 in the form of a cross which optionally allows passage of ground terminal 30. Preferably, scoring 38 does not penetrate the full thickness of front face surface 32 and thus preserves the sealing capabilities provided by gasket 12 when it is not needed. Scoring 38 however, will permit passage of ground terminal 30 if it is present on plug 26 and allows the penetration of the front face surface in that area.

Plug cover 14 is formed of semi rigid or rigid plastic material and defines a front cover panel 46. From the back side of the face surface 46 extends a pair of socket tabs 48 sized to be received by outlet socket slots 24.

Both gasket 12 and plug cover 14 are preferably formed by injection molding techniques.

Figure 3:
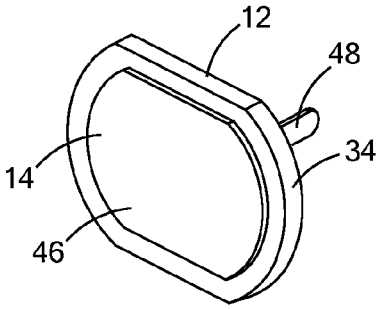
FIG. 3 is a view similar to FIG. 2, but showing the system or kit front surfaces.
Figure 4:
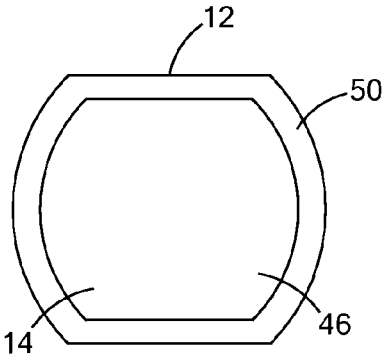
FIG. 4 is a frontal view of the system or kit.
Figure 5:
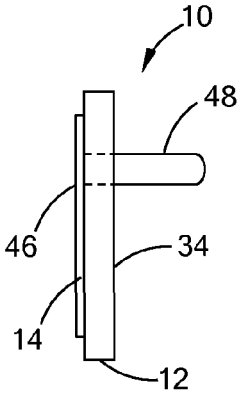
FIG. 5 is a side view of the system or kit.
Figure 6:
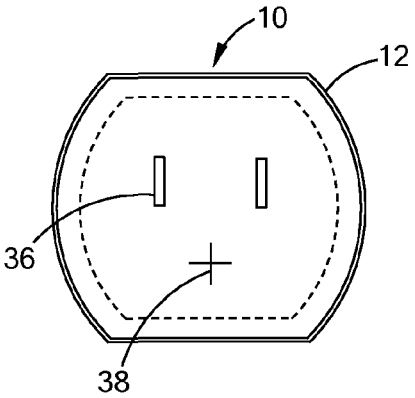
FIG. 6 is a rear view of the system or kit showing the perimeter of the plug cover element in phantom lines.
Figure 7:
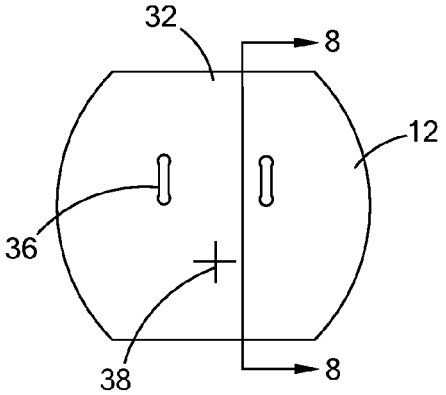
FIG. 7 is a front view of the gasket element.

When plug cover 14 is placed in position on the front surface of gasket 12 with socket tabs 48 penetrating gasket slots 36, as best shown in FIGS. 3 and 4, the outer perimeter of plug cover panel 46 defines a generally uniform width surrounding band 50 with the outer perimeter of gasket 12.

Figure 1:
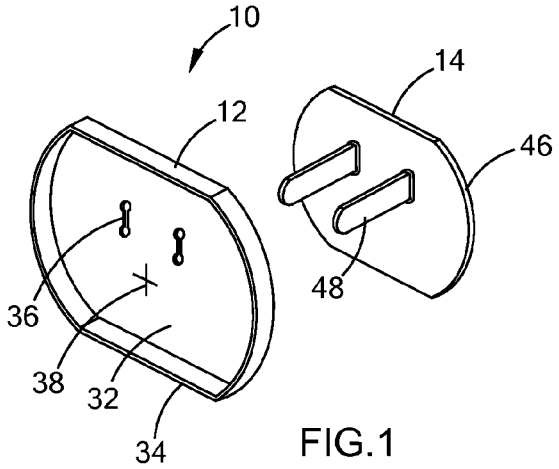
FIG. 1 is a perspective view of the sealing system or kit in accordance with this invention shown in an exploded position.
Figure 2:
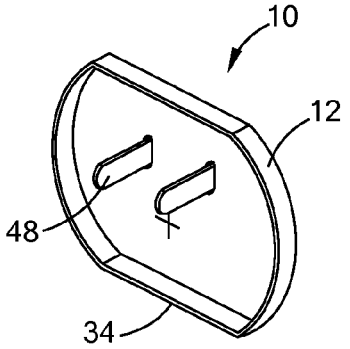
FIG. 2 is a perspective view of the sealing system or kit shown in FIG. 1 in an assembled condition.
Figure 10:
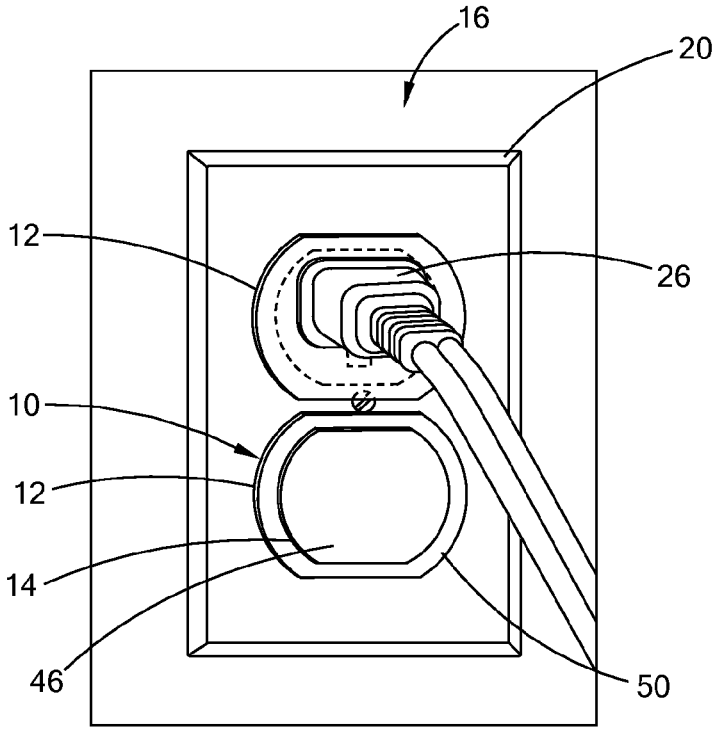
FIG. 10 is a perspective view of the sealing system in accordance with this invention used in connection with a building electrical duplex plug socket showing an electrical plug inserted in one socket with a gasket in accordance with this invention and with the gasket and plug cover in accordance with this invention installed in another of the sockets.

Use of electrical outlet sealing system 10 is illustrated in FIG. 10. Two modes of operation are available. In a first mode of operation, plug 26 is not present in the socket 18 and the user desires to reduce air infiltration through and around the plug sockets 18. As shown in the bottom portion of FIG. 10, plug cover 14 is installed with its socket tabs 48 penetrating gasket slots 36. This assembly (as shown in FIG. 2) is mounted by pushing socket tabs 28 into socket slots 24. Plug cover 14 is pressed into a fully inserted condition. In this position, gasket perimeter wall 34 contacts and seals against wall outlet cover 20. The depth of perimeter wall 34 accommodates the slight protrusion of the front surface of duplex sockets 18 extending from the front surface of cover 20. The presence of perimeter band 50 allows the material of gasket 12 to flex to accommodate dimensional variations in its contact with cover 20 (without crushing wall 34). The use of sealing system 10 in this mode of operation also provides a child safety feature preventing an infant or small child from accessing the electrical outlet slots 24 to prevent accidental electric shock.

In a second mode of operation, plug 26 is inserted into one of plug sockets 18 (the top one as shown in FIG. 10). In this mode of operation, only gasket 12 is used. When a plug 26 is used not having ground terminal 20, the spade terminals 28 are inserted through gasket slots 36. When plug 26 is fully inserted into connection with plug socket 18, the plug compresses gasket 12 against the socket, providing the sealing function mentioned previously. In the event that plug 26 features ground terminal 30, the ground terminal penetrates through scoring 38 allowing passage through gasket 12 and into socket port 25.

While the above description constitutes the preferred embodiment of the present invention, it will be appreciated that the invention is susceptible to modification, variation and change without departing from the proper scope and fair meaning of the accompanying claims.

The invention claimed is:

1. A system or kit for sealing a building electrical outlet of the type mounted within an interior wall of a building and having one or more electrical plug sockets adapted to receive an electrical plug and a cover plate, the system or kit for the reduction of air infiltration into the building through and around the electrical plug sockets, the system or kit comprising, a gasket formed of an elastomeric material having a face surface circumscribing the electrical plug socket and a perimeter wall extending from the face surface to contact and seal against the cover plate around the electrical plug socket, the gasket face surface having openings for permitting at least two electrical terminals of the electrical plug to penetrate through the gasket and be received by ports of the electrical plug socket, the electrical plug clamping the gasket against the electrical plug socket, the gasket acting to seal against air infiltration through a gap around the perimeter of the electrical plug socket.

2. A system or kit in accordance with claim 1 further comprising, the face surface of the gasket having scoring for an aperture for permitting penetration of a ground electrical terminal of the electrical plug.

3. A system or kit in accordance with claim 1 further comprising the gasket formed of a thin silicone rubber material.

4. A system or kit in accordance with claim 1 further comprising the face surface and perimeter wall having a generally equal thickness.

5. A system or kit in accordance with claim 1 further comprising the perimeter wall circumscribing the outer perimeter of the electrical plug socket.

6. A system or kit in accordance with claim 1 further comprising a plug cover having a front cover panel and a pair of extending tabs which engage the ports of the electrical plug socket to maintain the plug cover in position against the electrical plug socket when the plug cover is assembled with the gasket with the plug cover tabs extending through the gasket openings, wherein the front cover panel clamping the gasket face surface against the electrical plug socket.

7. A system or kit in accordance with claim 6 further comprising wherein the system may be used for sealing the electrical plug socket in a first mode of use when the electrical plug is not inserted into the electrical plug socket by installing the plug cover against the gasket and inserting the plug cover tabs into the electrical plug socket ports, and in a second mode of use when the electrical plug is used, wherein the electrical plug terminals penetrate the gasket openings without the plug cover used with the gasket, wherein the electrical plug compresses the gasket against the electrical plug socket.

8. A system or kit for sealing a building electrical outlet of the type mounted within an interior wall of a building and having one or more electrical plug sockets adapted to receive an electrical plug and a cover plate, the system or kit for the reduction of air infiltration into the building through and around the electrical plug sockets, the system or kit comprising, a gasket formed of an elastomeric material having a face surface circumscribing the electrical plug socket and a perimeter wall extending from the face surface to contact and seal against the cover plate around the electrical plug socket, the gasket face surface having slots for permitting at least two electrical terminals of the electrical plug to penetrate through the gasket and be received by ports of the electrical plug socket, the gasket face surface having scoring for an aperture for permitting penetration of a ground electrical terminal of the electrical plug, the scoring of the face surface providing a sealed surface until the ground electrical terminal penetrates the face surface, thereby forming the aperture, the electrical plug clamping the gasket against the electrical plug socket, the gasket acting to seal against air infiltration through a gap around the perimeter of the electrical plug socket.

9. A system or kit for sealing a building electrical outlet of the type mounted within an interior wall of a building and having one or more electrical plug sockets adapted to receive an electrical plug and a cover plate, the system or kit for the reduction of air infiltration into the building through and around the electrical plug sockets, the system or kit comprising:

a gasket the formed of an elastomeric material having a face surface circumscribing the electrical plug socket and a perimeter wall extending from the face surface to contact and seal against the cover plate around the electrical plug socket, the gasket face surface having openings for permitting at least two electrical terminals of the electrical plug to penetrate through the gasket and received by ports of the electrical plug socket, the gasket acting to seal against air infiltration through a gap around the perimeter of the electrical plug socket, and a plug cover having a front cover panel and a pair of extending tabs which engage the ports of the electrical plug socket to maintain the plug cover in position against the socket, wherein the front cover panel clamping the gasket face surface against the electrical plug socket.

10. A system or kit in accordance with claim 9 further comprising, the gasket face surface having scoring for an aperture for permitting penetration of a ground electrical terminal of the electrical plug.

11. A system or kit in accordance with claim 10 further comprising the scoring of the gasket face surface providing a sealed surface until the ground electrical terminal penetrates the face surface, thereby forming the aperture.

12. A system or kit in accordance with claim 9 further comprising the gasket formed of a thin silicone rubber material.

13. A system or kit in accordance with claim 9 further comprising the gasket face and gasket perimeter wall having a generally equal thickness.

14. A system or kit in accordance with claim 9 further comprising the perimeter wall circumscribing the outer perimeter of the electrical plug socket.

15. A system or kit in accordance with claim 9 further comprising wherein the system or kit may be used for sealing the electrical plug socket in a first mode of use when the electrical plug is not inserted into the electrical plug socket by installing the plug cover against the gasket and inserting the plug cover tabs into the electrical plug socket ports, and in a second mode of use when the electrical plug is used, wherein the electrical plug terminals penetrate the gasket openings without the plug cover used with the gasket, wherein the electrical plug compresses the gasket against the electrical plug socket.

16. A system or kit for sealing a building electrical outlet of the type mounted within an interior wall of a building and having one or more electrical plug sockets adapted to receive an electrical plug and a cover plate, the cover plate having a first side facing the interior wall and a second side facing away from the interior wall, the system or kit for the reduction of air infiltration into the building through and around the electrical plug sockets, the system or kit comprising, a gasket formed of an elastomeric material having a face surface circumscribing the electrical plug socket and a perimeter wall extending from the face surface to contact and seal against the cover plate around the electrical plug socket, the gasket disposed in contact with the second side of the cover plate, the gasket face surface having openings shaped to permit at least two electrical terminals of the electrical plug to penetrate through the gasket and be received by ports of the electrical plug socket, the electrical plug clamping the gasket against the electrical plug socket, the gasket acting to seal against air infiltration through a gap around the perimeter of the electrical plug socket.

* * * * *